US011867477B2

(12) United States Patent
Aguacia Acosta et al.

(10) Patent No.: US 11,867,477 B2
(45) Date of Patent: Jan. 9, 2024

(54) ASSAULT RIFLE CONVERSION KIT—FOLDING GUN STOCK ASSEMBLY

(71) Applicant: Industria Militar—INDUMIL, Bogota (CO)

(72) Inventors: Diego Armando Aguacia Acosta, Bogota (CO); Juan Camilo Baron Osorio, Soacha Cundinamarca (CO); Edward Zamir Lopez Medina, Bogota (CO); Hermis Alfonso Palacios Chavarriaga, Bogota (CO)

(73) Assignee: Industria Militar—INDUMIL, Bogota (CO)

( * ) Notice: Subject to any disclaimer, the term of this patent is extended or adjusted under 35 U.S.C. 154(b) by 247 days.

(21) Appl. No.: 17/416,942

(22) PCT Filed: Nov. 25, 2019

(86) PCT No.: PCT/IB2019/060141
§ 371 (c)(1),
(2) Date: Jan. 31, 2022

(87) PCT Pub. No.: WO2020/128684
PCT Pub. Date: Jun. 25, 2020

(65) Prior Publication Data

US 2022/0155041 A1 May 19, 2022

(30) Foreign Application Priority Data

Dec. 21, 2018 (CO) ..... NC2018/0014000

(51) Int. Cl.
*F41C 23/04* (2006.01)
*F41A 11/04* (2006.01)
*F41C 23/14* (2006.01)
*F41C 23/16* (2006.01)
*F41G 1/12* (2006.01)

(52) U.S. Cl.
CPC ..... *F41C 23/04* (2013.01); *F41A 11/04* (2013.01); *F41C 23/14* (2013.01); *F41C 23/16* (2013.01); *F41G 1/12* (2013.01)

(58) Field of Classification Search
CPC ..... F41C 23/14; F41C 23/04; F41C 23/16; F41A 11/04; F41G 1/12
USPC ..... 42/75.03, 73, 71.01
See application file for complete search history.

(56) References Cited

U.S. PATENT DOCUMENTS 3,369,316 A * 2/1968 Miller ..... F41C 23/04 42/72
4,463,654 A 8/1984 Barnes et al.
4,513,523 A * 4/1985 Gal ..... F41C 23/04 42/72

(Continued)

*Primary Examiner* — Michael D David
(74) *Attorney, Agent, or Firm* — Defillo & Associates, Inc.; Evelyn A. Defillo

(57) ABSTRACT

The present invention is related to an Assault Rifle Conversion Kit, which is characterized by being an alternative for modernization, updating and tactical adaptation to existing and new assault rifles through adjustments that involve minor changes in the weapon and that provide a tactical character for its use in special operations and of great demand. The present conversion kit mainly comprises six selected sets of stock set, tactical grip set, second grip set, cover set, reload handle set and forearm set which can be attached to different types of assault rifles, due to the versatility of adaptation they have.

16 Claims, 8 Drawing Sheets

(56) References Cited

U.S. PATENT DOCUMENTS 5,209,215 A * 5/1993 Morrison ..... F41B 5/12 403/96
6,250,194 B1 6/2001 Brandl et al.
6,470,617 B1 * 10/2002 Gregory ..... F41A 11/04 42/75.02
7,802,392 B2 * 9/2010 Peterson ..... F41C 23/14 42/75.03
7,827,721 B2 * 11/2010 Griffin ..... F41C 23/04 42/71.01
D636,834 S * 4/2011 Mayberry ..... F41C 23/04 D22/108
7,941,958 B1 * 5/2011 Zedrosser ..... F41A 11/02 42/75.01
7,966,761 B1 * 6/2011 Kuczynko ..... F41C 23/04 42/73
8,109,026 B1 * 2/2012 Bentley ..... F41C 23/04 42/73
8,205,373 B1 6/2012 Ubl et al.
8,312,661 B2 * 11/2012 Ludlow ..... F41C 23/04 42/73
8,429,844 B2 * 4/2013 Dextraze ..... F41A 9/71 42/73
8,464,458 B2 * 6/2013 Chvala ..... F41C 23/20 42/73
8,631,601 B2 * 1/2014 Langevin ..... F41C 23/04 42/73
8,640,373 B2 * 2/2014 Burt ..... F41C 23/02 42/85
8,656,623 B1 * 2/2014 Chvala ..... F41C 23/04 42/73
8,769,855 B2 * 7/2014 Law ..... F41C 23/14 42/73
8,819,981 B2 * 9/2014 Malik ..... F41C 23/04 42/72
8,915,005 B2 * 12/2014 Grimshaw ..... F41C 23/04 42/73
9,194,635 B1 * 11/2015 Gibbens ..... F41A 3/12
D745,627 S * 12/2015 Kielsmeier ..... D22/108
9,228,795 B1 * 1/2016 Kielsmeier ..... F41C 23/04
9,239,203 B2 * 1/2016 Jarboe ..... F41A 3/18
9,347,738 B1 * 5/2016 Schumacher ..... F41A 3/26
9,464,863 B2 * 10/2016 Mather ..... F41C 23/14
9,546,845 B2 * 1/2017 Mather ..... F41A 3/66
9,664,478 B2 * 5/2017 Robinson ..... F41C 23/04
9,829,272 B2 * 11/2017 Brown ..... F41C 23/04
10,088,265 B2 * 10/2018 Underwood ..... F41C 23/20
10,113,830 B2 * 10/2018 Monveldt ..... F41A 35/06
10,156,421 B2 * 12/2018 Smith ..... F41C 23/14
10,260,837 B1 * 4/2019 McGinty ..... F41A 3/84
10,704,848 B1 * 7/2020 Zeider ..... F41A 3/66
11,313,643 B2 * 4/2022 Yollu ..... F41C 23/04
2010/0186276 A1 7/2010 Herring
2012/0144712 A1 * 6/2012 Rostocil ..... F42B 14/064 42/59
2015/0176945 A1 * 6/2015 Simek ..... F41C 23/14 42/75.03
2016/0116250 A1 * 4/2016 Mather ..... F41A 3/66 42/73
2017/0010065 A1 * 1/2017 Kielsmeier ..... F41C 23/14
2018/0073835 A1 * 3/2018 Saltzman ..... F41C 23/06
2019/0212095 A1 * 7/2019 Ballard ..... F41A 11/04
2021/0348877 A1 * 11/2021 Saunders ..... F41C 23/14
2022/0074702 A1 * 3/2022 Levi ..... F41C 23/14

* cited by examiner (4a)

(4b)

(4c)

ASSAULT RIFLE CONVERSION KIT—FOLDING GUN STOCK ASSEMBLY

TECHNOLOGY SECTOR

The present invention is related with the technological sector of weapons, in particular of individual firearms such as rifles. Specifically, the invention relates to shoulder-rest firearms such as rifles and their parts such as stocks, handles, forend and various accessories for rifles.

BACKGROUND OF THE INVENTION

The technological sector that includes the use and manufacture of firearms, in particular those that can be supported on the shoulder such as rifles, has a multiplicity of developments that always seek to reduce the rate of fire and increase its precision at high lengths, due to the decrease in the use of weapons at short distances and advances in tactical operations at medium and high distances, which have allowed greater effectiveness in the use of weapons.

In terms of use, it is common to find popular rifles due to their effectiveness, low cost, versatility or reputation due to their references in combat. These rifles currently require an update or modernization to fit in with the new combat tactics that tend to avoid close combat, changing the type of application for which it was developed.

Also, technological and military advances have allowed the development of powerful sighting systems, vision multipliers, lasers, night accessories and, in general, all kinds of accessories with benefits for use in tactical operations, related combat and training exercises. Assault rifles have the problem of being widely used because of its low cost, but usually support tactical with that count for use in operations is very limited or even zero.

So, the arms race is forced to improve the quality and performance of weapons, but the cost associated with the complete change of a weapon is too high for the total change of weapons of a nation, for example. The present invention meets the needs of modernization and tactical adaptation to assault rifles, avoiding the purchase of new weapons and with a reduced manufacturing cost.

Additionally, an important characteristic in the use of weapons is their ergonomics and maneuverability, due to the diversity of anthropometric or lateral characteristics of the users, a complete coupling to them is necessary, and shortcomings in the adaptability and ergonomics of the weapon end. decreasing the user's precision due to possible numbness of the upper extremities and even causing injuries due to unnecessary pressure on the carpal tunnel[1].

In terms of adjustments to weapons to increase their performance, the U.S. Pat. No. 8,448,366 B2 provides an advance on the conversion of pistols to a short-barreled rifle, including certain modifications such as a stock and devices for attaching sights, with the disadvantage of being a modification to a short-range weapon, not being adjustable, nor have an ergonomic character; This limits the use in real tactical operations, where a distance of fire greater than that obtained with a pistol is necessary and the complete adaptation of the weapon to the user and remarkable ergonomics is crucial, due to their complexity and duration.

In the other hand, U.S. Pat. No. 8,205,373 B1 provides an adaptation to AR-15 assault rifles, without including its adaptation to other possible rifles and with important modifications to the weapon, which increases its cost. Said document also does not provide adjustments to the stock of the weapon, lacks an ergonomic grip, does not regulate the temperature in the forearm, nor does comply the need for the connecting of multiple devices; decreasing its applicability and functionality, where the present invention has remarkable advances.

The present invention has adaptability to any rifle with minor or null modifications of the weapon, it presents a kit of assemblies that represent different technical advantages in terms of temperature, precision, maintenance and cost for its adaptation to new assault rifles with emphasizing its fully ergonomic character for a meaningful fit with the user.

BRIEF DESCRIPTION OF THE INVENTION

The present invention is related to the different devices and components that are part of individual weapons such as rifles, as well as with the elements and mechanisms that make up such weapons and provides a technical solution to the need for adaptation, modernization and updating of rifles, for their use in tactical and precision operations to existing and new assault rifles, through minor or no modifications to different types of rifles, due to their versatility in installation.

The Assault Rifle Conversion Kit (100) comprises a handguard assembly (A), a reloading handle assembly (B), a stock assembly (C), a tactical handle assembly (D), a second-grip (E) and a cover assembly (F), as shown in FIG. 1, which are assembled on a selected rifle and together allow a tactical adaptation with minor or no modifications of the rifle and providing an ergonomic assembly with different advantages for the adaptation to different types of people who may have different anthropometric and lateral traits; which is an advantage of the present invention.

The handguard assembly (A) is responsible for providing protection to the high temperatures presented in the barrel when the weapon is fired and offers the possibility of adapting tactical elements such as a second grip, a laser and sights, among others. FIG. 2*a* shows the handguard assembly in an isometric view where the handguard is seen in one modality of the present invention.

In addition to this, Assault Rifle Conversion Kit (100) comprises a reload handle assembly (B), which seeks to adapt the existing reload handle on some assault rifles. It consists of an adaptation from vertical to horizontal position, since it is an objective of tactical adaptation to include equipment on the Picatinny rails, so if it is vertical, said handle can interfere with accessories and equipment. An isometric of the refill handle assembly is shown in FIG. 3*b*.

The present invention also has a stock assembly (C) shown in FIG. 4, which provides a practical and complete solution to the need to support the rifle on the shoulder to reduce the recoil force and increase the accuracy of consecutive shots. The stock assembly (C) comprises a folding mechanism with lock (C1) which provides the possibility of folding the stock for transporting and carrying the weapon. It also includes a retractable telescopic button mechanism (C2) for graduation to different types of users and an adjustable cheek-rest system (C3) also to ergonomically facilitate the grip and aim with the rifle in a suitable and ergonomic way. The stock set (C) also has a fully adjustable cheek rest system (C3) that allows the user to rest the cheek and level the sight and aim of the weapon during the weapon's grip, which gives it the functionality of a better visualization for shooting.

Likewise, the present invention comprises a set of tactical grips (D), which seeks to improve the poor grip typical of assault rifles, through the implementation of a completely ergonomic grip, which adapts perfectly to the user's hand, resembling the grip of a pistol.

The second handle assembly (E) is characterized by providing additional support to the weapon, to balance the recoil forces of the same and provide a more stable handle giving an additional firmness to the user, which when taking consecutive shots will have a positive impact on their precision. The second grip assembly is characterized by comprising an adaptable geometry and fully compatible with the Picatinny rails that comprise the forearm assembly (A). An isometric view of the second handle assembly (E) is shown in FIG. 7*a*.

In addition, the cover set (F) is characterized by understanding the adaptation to any type of cover without damaging its components or making major modifications and confers the tactical ability to couple different tactical devices such as sights, lasers, vision multipliers, among others.

DESCRIPTION OF THE FIGURES

FIG. 4*c* shows a sectional view of the button mechanism of the cylinder head assembly (C) is shown.

DETAILED DESCRIPTION OF THE INVENTION

The Assault Rifle Conversion Kit (100) is related to the different devices and components that are part of individual weapons such as rifles, as well as the elements and mechanisms that make such weapons, and provides a technical solution to the need of adaptation, modernization and updating of rifles, conferring properties for their use in tactical and precision operations to existing and new assault rifles, through minor or no modifications to different types of rifles, due to their versatility in installation.

Figure 1:
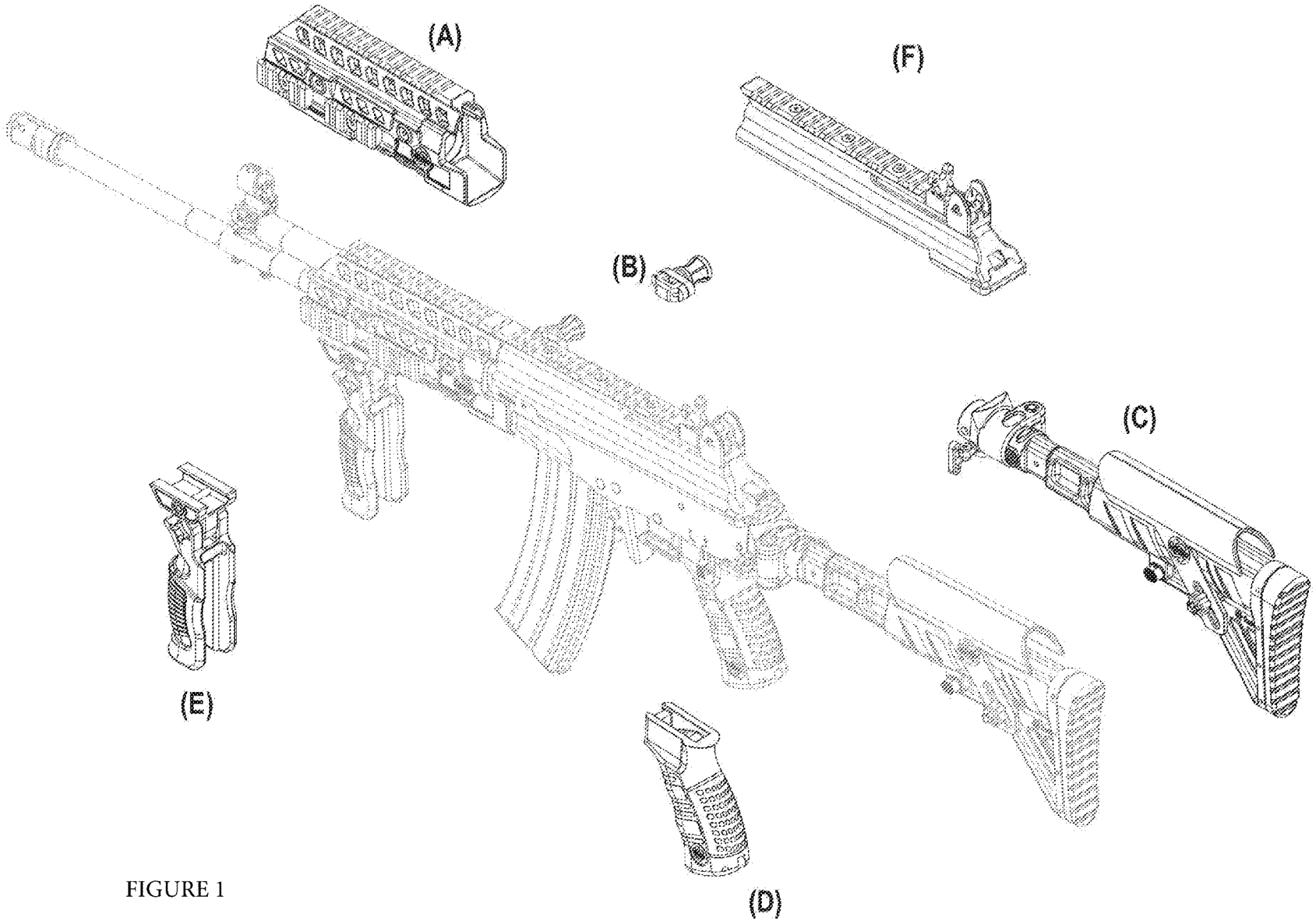
FIG. 1 shows an isometric view of one modality of the assemblies of the present invention and their installation in a rifle.

The Assault Rifle Conversion Kit (100) comprises a handguard assembly (A), a reloading handle assembly (B), a stock assembly (C), a tactical handle assembly (D), a second-grip (E) and a cover assembly (F), as shown in FIG. 1, which are assembled on a selected rifle and together allow a tactical adaptation with minor or no modifications of the rifle and providing an ergonomic assembly with different advantages for the adaptation to different types of people who may have different anthropometric and lateral traits; which is an advantage of the present invention.

Figure 2:
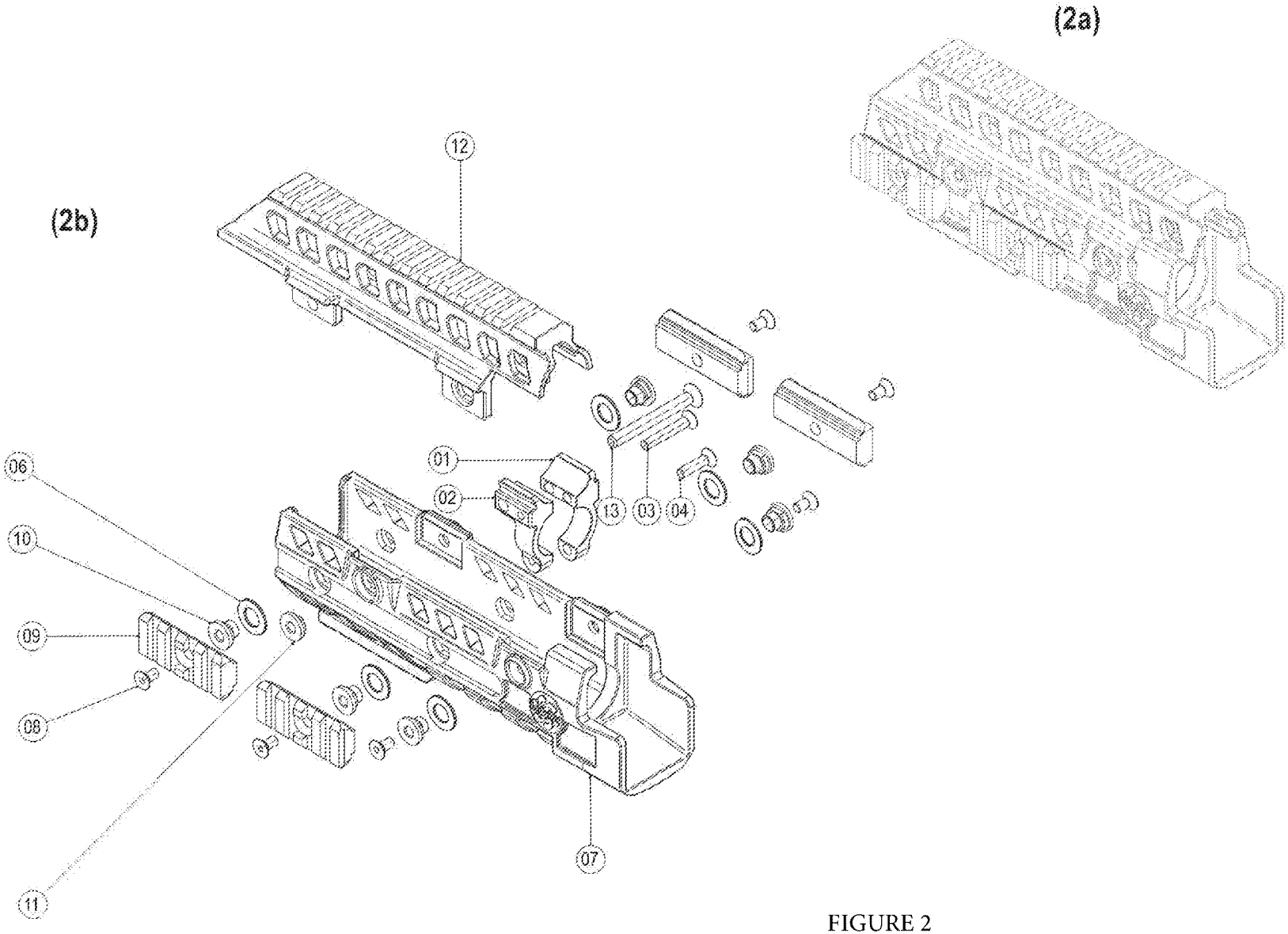
FIG. 2*a* shows an isometric of one modality of the assembled handguard assembly (A).
FIG. 2*b* shows an isometric of the exploded view of one modality of the handguard assembly (A).

The Assault Rifle Conversion Kit (100) includes a set of handguards (A) which is responsible for providing protection to the high temperatures presented in the barrel when the weapon is fired and offers the possibility of adapting elements tactics such as a second grip, a laser and sights, among others. FIG. 2*a* shows the handguard assembly in an isometric view where the handguard is seen in one modality of the present invention.

For its part, the handguard assembly (A) comprises a heat sink assembly (A1) which, due to its geometry, arrangement and materials, provides an innovative system to dissipate the high temperatures that commonly occur in the barrel of the rifle, where it can be adapted without major modification, which is an additional advantage for incorporation into different types of rifles, including rifles that were already in use.

The heat sink assembly is fixed to the barrel of the rifle, by means of a mechanism similar to that of a clamp that comprises a right handguard support (1) and a left handguard support (2). Said support when it is armed is related in its internal cavity with a cylinder and allows a firm fixation to the barrel of the weapon, it has a length proportional to the free length of the barrel and to the weight of the forearm, which allows a firm hold, without displacement. nor risk of fracture, and that in turn the area in contact is such that heat transfer is minimized.

The right handguard support (1) and the left handguard support (2) are joined by multiple screws, in one modality of the present invention the fixing is given by three screws, these being the upper handguard support screw (3), the forend screw lower support (4) and handguard screw (13). This set, unlike other adaptations, is novel in the selection of the material used in its manufacture, due to the choice of a material that has a lower thermal conductivity selected from a stainless steel, not present in other modalities, which gives this invention is a novelty in terms of safety for the user, due to the fact that the heat transfer that occurs between the barrel and the forearm assembly (A) is much lower than that of conventional fixing devices; this being a differentiating factor due to the high temperatures that it can reach during continuous fire (650° C. during continuous firing of 350 cartridges) and that due to the implementation of the present invention allow an admissible temperature for the user and allow the polymeric material of the adaptive tactical handguard assembly (A2) has greater durability.

The heat sink assembly (A1) is attached by means of multiple handguard screws (13) attached to the insulator (5) to the adaptive tactical handguard assembly (A2). The insulator (5) is presented as a material selected from aluminum due to its high thermal conductivity and considerable area, which allow adequate and favorable heat dissipation for the weapon, and which together with the openings of the forearm (7) allow adequate dissipation of heat transferred from the barrel. The insulator is attached to the handguard by means of multiple spacers (6) and multiple handguard nuts (10), which allow an adequate distance for heat dissipation and allow a minimum transfer to the handguard (7), which will allow to the polymeric material of the handguard (7) have a greater durability.

The handguard set (A) also comprises an adaptable tactical handguard set (A2), characterized by being a solution to the need to incorporate tactical attachments to the weapon by incorporating multiple Picatinny type rails, which provides a standardized platform for the adaptation of all types of sights, vision multipliers, lasers for different objectives due to its geometry in accordance with the international standard STD-1913.

The adaptable tactical handguard assembly (A2) comprises a handguard (7), a handguard cover (12) joined with the handguard screw (13) and the fastening screw nut (11) to the right handguard support (1) and the handguard support left (2), attached to the barrel of the rifle. The handguard (7) has multiple false Picatinny rails (9) selected as 6 in one modality of the present invention, which allow its disassembly of the handguard (7) by disassembling a plurality of handguard picatinny screw and cover (8), which give the shooter or user the possibility of disassembling them for greater comfort in the grip and use of the weapon. The handguard (7) and the handguard cover (12) also have two fixed Picatinny rails, one on the handguard (7) at the bottom and the other on the handguard cover (12), which in combination with the Picatinny false rails (9) allow the holding of selected tactical devices such as a second handle assembly (E) or different sights, telescopic sights, lasers, vision multipliers, among others.

The forearm assembly (A) presents a graceful solution to the tactical adaptation to improve the precision of the weapon, reducing the rate of fire and saving ammunition and money, the latter due to the fact that it does not need a new barrel to be implemented in any rifle. The modification of the original forearm by the forearm assembly (A) normally requires a new barrel, since it is not feasible to disassemble the elements attached to the barrel as it presents a low percentage of success and consists of the need to align the barrels, parts of the barrel so, that the slots I thereof (which stabilize the projectile) and also components of gas powered recharging (which allows n to extract the bushing, integral part of automatic or semiautomatic weapons) coincide again; which makes the present invention a solution that can be extrapolated to different types of rifle, without substantial modifications.

On the other hand, are common the fixing rail Picatinny directly to the gas pipe which due to the conditions of use of guns that can occur in rain forest conditions even by moisture, rain, mud and own dirt location or the use, requires proper cleaning and maintenance, even in conditions of direct conflict, which prevents recalibration of the weapon's tactical devices or "re-zero". The present invention has a handguard cover (12) that is arranged in such a way that the disassembly of the gas tube does not alter the fixation of accessories such as sights, multipliers, lasers, among others and therefore the precision of the weapon is not affected, since in cleaning and maintaining the rifle it continues with the same alignment and will not need a recalibration or "re-zero" the weapon by firing it, which is an impractical situation in many direct war scenarios.

Figure 3:
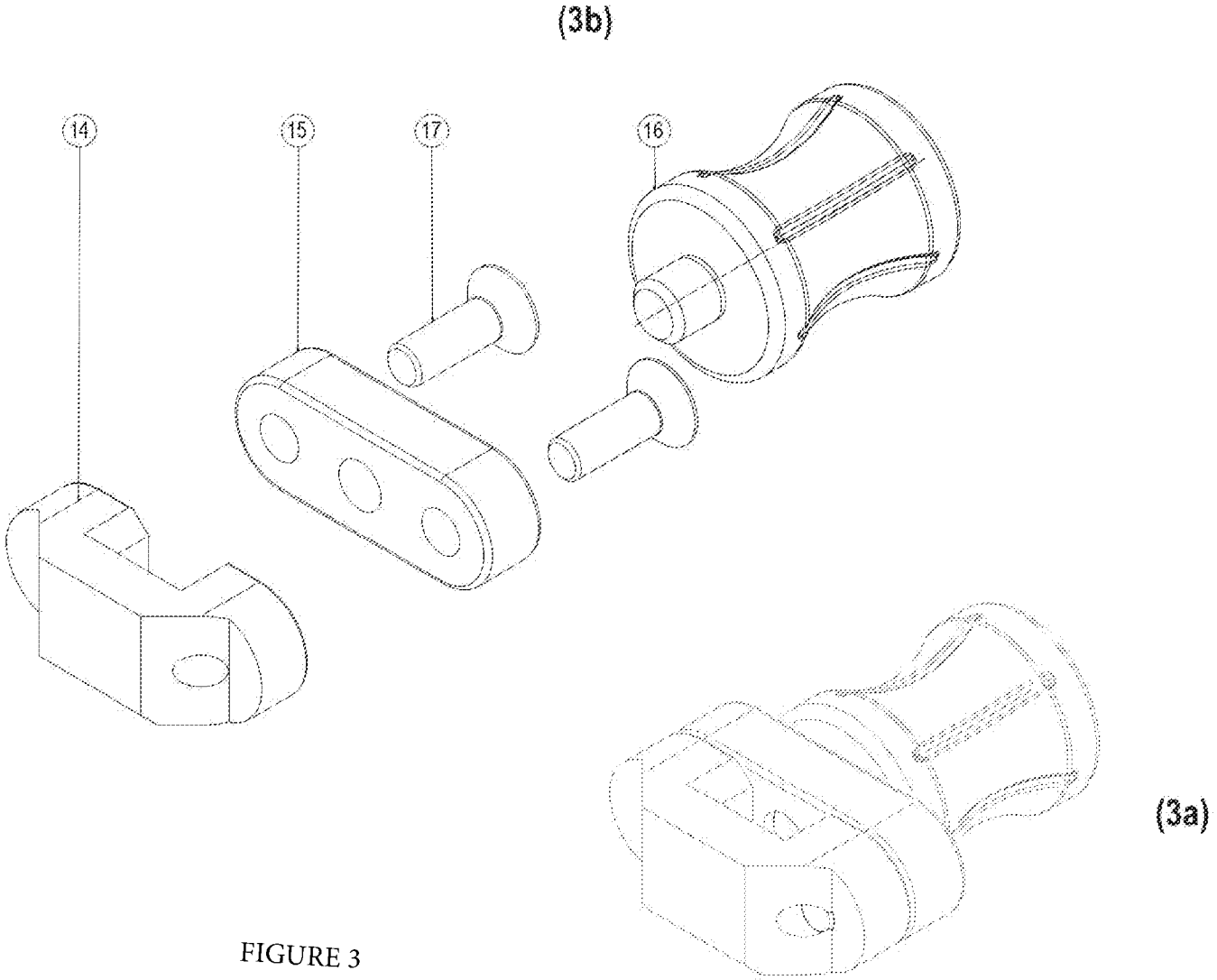
FIG. 3*a* shows an isometric of one modality of the assembled refill handle assembly (B).
FIG. 3*b* shows an isometric exploded view of one modality of the refill handle assembly (B).

Additionally, the Assault Rifle Conversion Kit (100) comprises a reload handle assembly (B), which seeks to adapt the existing reload handle on some assault rifles. It consists of an adaptation from vertical to horizontal position, since it is an objective of tactical adaptation to include equipment on the Picatinny rails, so if said handle is vertical, it can interfere with accessories and equipment. An isometric of the refill handle assembly is shown in FIG. 3*b*.

The reload handle assembly (B) is the only assembly of the present invention that needs to partially modify the weapon; modifying only the current refill handle, by cutting it in a place that allows a change in its cross section for a larger one, to avoid slipping in it. For coupling with the rest of the vertical refill handle, the refill handle assembly (B) comprises a refill handle base complement (14) and a refill handle base (15), which are arranged in said section as clamp and have an internal geometry that matches the remainder of the vertical reload handle and are attached by two reload handle screws (17). The reloading handle base (15) comprises a threaded hole to allow the stable insertion of the reloading handle (16), which will have a geometry that allows the reloading of the weapon, providing ergonomics to the user and due to its the new horizontal arrangement will allow the user to reload the weapon without deteriorating or altering the location or compromising the integrity of these, an exploded view of the reloading handle assembly is shown in FIG. 3*a*.

Figure 4:
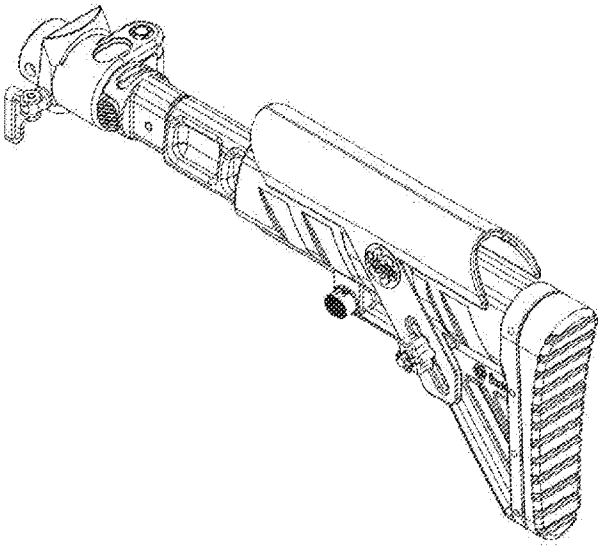
FIG. 4 shows an isometric of the cylinder head assembly (C) in isometric. Figure the 4*a* show one modality where the head is hinged to the right and in FIG. 4*b* is an modality showing where the head is hinged to the left using the same mechanism.
Figure 4:
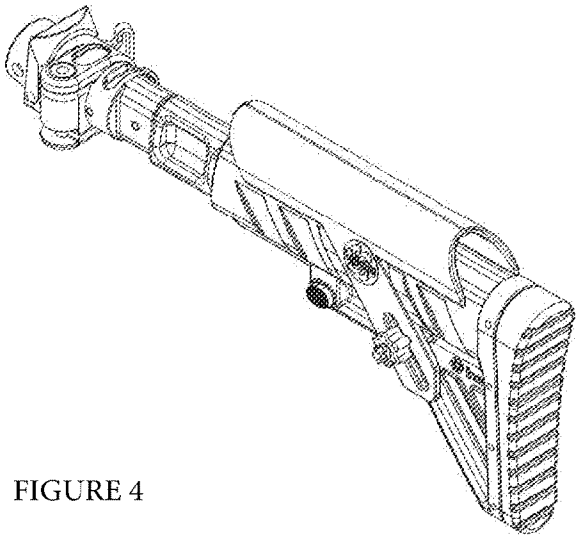
Figure 4:
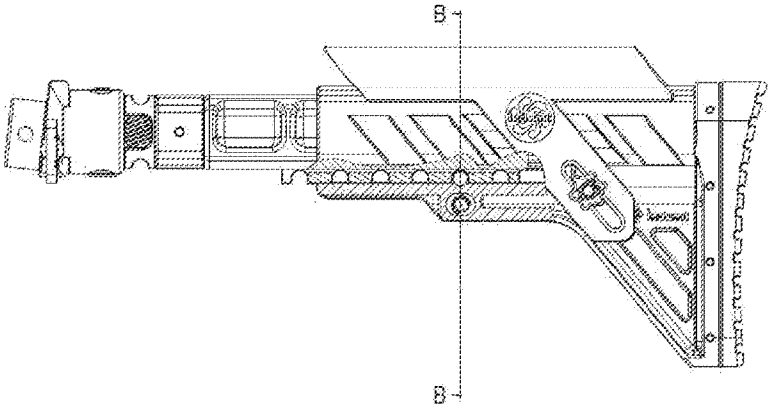
Figure 4:
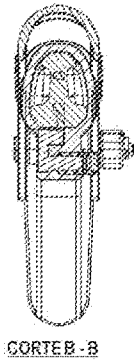

The present invention also has a stock assembly (C) shown in FIG. 4, it offers a practical and complete solution to the need to support the rifle on the shoulder to reduce the recoil force and increase the accuracy of consecutive shots. The stock assembly (C) comprises a folding mechanism with lock (C1) which provides the possibility of folding the stock for transporting and carrying the weapon. It also includes a retractable telescopic button mechanism (C2) for graduation to different types of users and an adjustable cheek-rest system (C3) also to ergonomically facilitate the grip and aim with the rifle in a suitable and ergonomic way.

Figure 5:
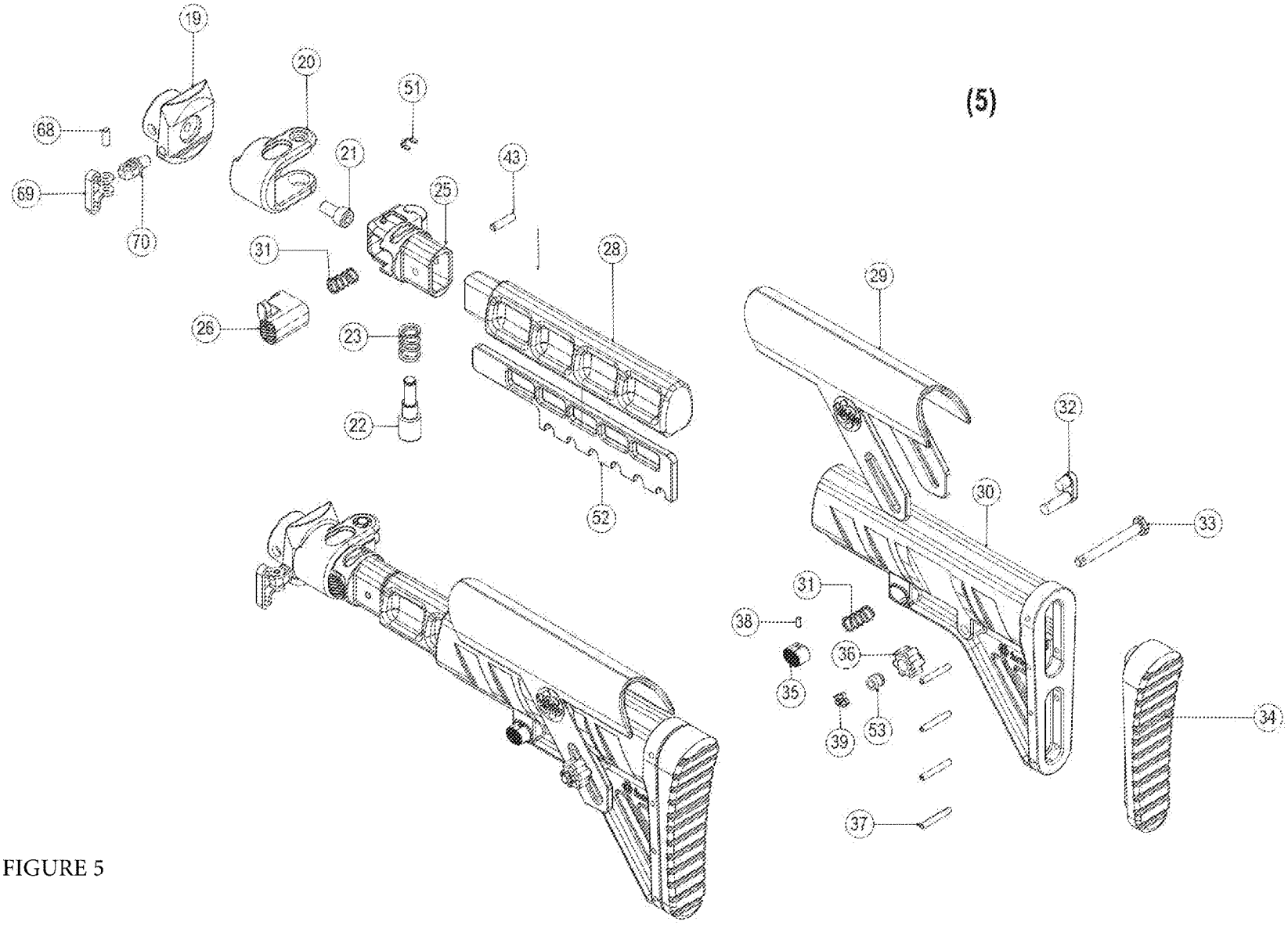
FIG. 5 shows an isometric exploded view of the cylinder head assembly (C).

The folding mechanism with lock (C1) shown in a general exploded view of the cylinder head assembly (C) in FIG. 5, allows the user to load the gun with a smaller length to the total that would be deployed for the transport of the weapon or of the user carrying the weapon. It provides a folding system that allows its configuration for users with different lateralities, either left-handed or right-handed, since the mechanism allows, with the rotation of the system's own components, the adaptation to right-handed or left-handed users so that according to preference they can load the weapon with its stock folded in the preferred direction without implying discomfort when loading it or the need to release the trigger of the weapon, which is important in use during special operations where the need to shoot may arise without the time to deploy the stock, which confers the tactical property of timely fire to all types of users regardless of their laterality and ergonomics and comfort in carrying the weapon.

The folding mechanism with lock (C1) comprises a stock base adapter (19) that is attached to the rear of the assault rifle, with the possibility due to its geometry of being rotated to change the direction in which the folding stock will be folded, and It is fixed to the weapon by means of a stock bolt (18), which will elastically deform to allow entry and the stock base adapter and has the proper dimensions to fit with a minimum tolerance with the rifle. The cylinder head base adapter (19) is attached to the cylinder head base block (20) by means of a screw (21) which can be turned through an angle of 180° to fold the cylinder head in the opposite direction without the use of a specialized tool. The cylinder head base block (20) also has a geometry that allows the insertion of the joint block (25) and contains a change in section that will allow the locking of the joint block (25) by means of geometric interference, to prevent the cylinder head from having displacements unwanted in their downcast position.

The joint block (25) also fulfills the function of housing the cylinder head base shaft (22) that will allow the locking mechanism of the cylinder head to be released to unfold it and also houses the components that will allow the mechanism to fold it down. The cylinder head base shaft (22) is characterized by being cylindrical with different section changes and where one of those section changes is used to secure the shaft by means of the cylinder head fixing ring (51) which will prevent the shaft from being ejected by spring base (23) and also allows the shaft back into position the original. The head base axis (22) also allows the union (25) block has a vertical movement provided by the basic spring (23), wherein said movement occurs during rotation of the head to fold down and where said vertical displacement of the joint block (25) is what generates a geometric interference with the cylinder head base block (20) to block unwanted movements.

The folding mechanism with lock (C1) is activated to fold the cylinder head through the cylinder head basis button (26) which comprises two projections, the most prominent of them with a knurling at the top to ensure its operation of the user and the second projection destined to generate a geometric interference between the cylinder head base block (20) and the cylinder head base button (26) and will remain in the initial position due to the driving effect generated by the cylinder head button spring (31) between the button cylinder head base (26) and the union block (25) and where the elastic coil pin (24) prevents the button mechanism from being ejected and fixes it to the union block (25), on the other hand, when the base button is pressed cylinder head (26) the cylinder head button spring (31) is compressed, freeing the joint block (25) from said interference and allowing the mechanism to fold the cylinder head down.

The junction block (25) has a threaded hole to include a rifle holder system so that the user can load the weapon by the use of fasteners, slings or straps with multiple anchor points allowing it to be loaded ergonomically and reduce the load. effort and the exhaustion of carrying the weapon only with the arms, which will translate into greater firmness when holding the weapon and consequently greater precision. Said rifle holder system is characterized by comprising a weapon holder screw (70), to which a weapon holder ring (69) will be attached by means of a weapon holder ring pin (68) allowing the rotation of the weapon holder ring (69) on its shaft, which allows the adaptation of the gun holder system to the desired loading position.

The union block (25) also includes a slot where the retractable telescopic button mechanism (C2) joins with the folding mechanism with lock (C1), where the cylinder head guide body (28) will be in charge of engaging the union block (25) by means of an elastic pin (43). The cylinder head guide body (28) and the cylinder head guide body core (52) are characterized by being permanently joined and by being made of different materials. For its part, the cylinder head guide body (28) is characterized by being made of a selected polymer material to facilitate its injection into a mold and also has the property of being light and having different types of grooves geometry that allow its weight to be lightened. On the other hand, the cylinder head guide body core (52) is characterized by being made of a metal material of great hardness and density to allow the telescopic mechanism to have greater durability and resistance, it has a plurality of grooves in its lower part that will be those in charge of providing the space for a geometric interference necessary to firm up the positions available in the retractable telescopic button mechanism (C2), selected from six positions in one modality of the present invention. In another mode of the present invention, it also has holes in its upper part arranged to alleviate its weight and to generate a more stable union between the polymer injected directly into the cylinder head guide body (52) and the geometry of the body. cylinder head guide (28) (which will be generated by injection into a mold) which implies that said parts are completely welded and have the mechanical advantages of steel, with a reduction in weight due to the large volume that the polymer occupies without risking its properties of durability and resistance to use.

The retractable telescopic button mechanism (C2) bases its operation on the actuation of a cylinder head button (35) which has a knurled surface that will be in contact with the user to guarantee a precise actuation, it also includes a hole arranged to that the stock retainer (32) can enter it and another perpendicular to it so that the elastic coil pin (38) joins the stock retainer (32) with the stock button (35) firmly and said union will prevent the complete exit of the cylinder head guide body (28) from the cylinder head (30), that is to say, it prevents the complete disassembly of the telescopic mechanism accidentally.

The cylinder head retainer (32) is characterized by being a solid piece preferably made of durable, hard materials, and with resistance to shear stress such as steel or some aluminum. Said piece has a base from which two projections, the most prominent of which comprises a cylinder head button spring (31) along its span, which is responsible for returning the cylinder head button (35) to the block position automatically, said projection in its upper part has a hole that will house the elastic coil pin (38). The less prominent projection is in charge of blocking the selected position of the retractable telescopic mechanism by means of a geometric interference between the cylinder head guide body core (52) and the cylinder head retainer (32), which will be restricted from turning by the cylinder head cavity (30) that matches the geometry of the cylinder head seal.

The cylinder head (30) is then in charge of having the cavity for the cylinder head guide body (28) creating the relative linear displacement typical of a telescopic system, of having the cavities with the necessary shape that connects to the cylinder head button (35) and the retainer cylinder head (32) for actuating the retractable telescopic button mechanism (C2) preventing its rotation and allowing its linear movement. It also has enough holes to fix a stockplate (34) and the cheek support system (C3).

The stockplate (34) is fixed to the stock (30) by means of a plurality of elastic spiral pins (37) and is characterized by being made of a material selected from shock absorbing materials such as rubber. It is characterized by having a curved geometry that tends for ergonomics and adaptation to the user's shoulder and a series of grooves that together with its curved geometry help the rifle not slip from the user's shoulder, to avoid injuries typical of the lack of firmness in the recoil of the weapon and also to avoid involuntary sliding of the weapon that can change the target at which it is aimed during the grip of the rifle, which increases the level of firmness in the grip of the weapon and therefore its precision, giving a tactical character to the cylinder head assembly (C).

The stock set (C) also has a fully adjustable cheek-rest system (C3) that allows the user to rest the cheek and level the sight and aim of the weapon during the weapon's grip, which gives it the functionality of a better visualization at shooting. The present cheek support system (C3) has a mechanism capable of regulating the height of the line of sight where the cheek rests continuously, providing complete adaptation to the different anthropometric conditions of the user and to different heights. that can have the sights, vision multipliers, among other accessories to aim the rifle necessary, providing a tactical, comfortable, ergonomic and simple solution to the need to aim the rifle for shots at long distances. The present cheek support system (C3) is characterized by its comfortable use by people of different lateralities (right-handed or left-handed) due to the symmetry present in its geometry, it is also characterized by allowing the arrangement of the fastening elements in opposite directions to the place where the cheek rests, allowing the cheek to rest comfortably.

The cheek rest system (C3) comprises a light cheek rest (29) that allows the user's cheek to rest during the grip of the weapon, which is attached to the stock (30) by means of a support shaft.—cheek (33) which is characterized by being at one of its ends a selected form of prism, square, hexagon, among others, and in general any that prevents the rotation of the cheek-rest axis (33) on its own axis, the other end has a threaded length to hold a device composed of a cheek-rest knob nut (36) and a cheek-rest knob insert (53). For its part, the cheek-rest knob insert (53) is characterized by having an internal threaded geometry to allow the entry of the cheek-rest axis (33) and being made of a selected metallic material of steel, aluminum, among others, compatible with the material of the cheek support shaft (33) and that allows sufficient torque to hold the cheek support without showing wear; Said cheek-rest knob insert (53) is characterized by being part of the cheek-rest knob nut (36) which is characterized by being made of a polymeric material and by having an external shape large enough and ergonomic to allow maneuverability with the fingers of the user and the one mode of the present invention is characterized by being carried out by injecting the polymer into a mold where the cheek-rest knob insert (53) is located, making these two a single piece.

The cheek rest (29) is characterized by being a piece with an axis of symmetry, which contains two lateral grooves for inserting the cheek rest axis (33) for its subsequent torque against the cylinder head (30) by means of the set formed by the cheek rest knob insert (53) and the cheek rest knob nut (36) and will allow the insertion of the cheek rest axis (33) on either side of its axis of symmetry, so that the nut cheek rest knob (36) does not bother the user. The present cheek rest system (C3) also has a dowel pin (39) which prevents the assembly formed by the cheek rest knob insert (53) and the cheek rest knob nut (36) from accidentally coming out of its union with the cheek rest axis (33) allowing the user to always have the cheek rest system (C3).

The Assault Rifle Conversion Kit (100) comprises a set of tactical grip (D), which seeks to improve the poor grip typical of assault rifles, by implementing a completely ergonomic grip, which is perfectly adapted to the user's hand, resembling the grip of a pistol and is characterized by comprising in its geometry multiple grooves in the manner of engravings that prevent the sliding of the user's fingers and with multiple grooves in prismatic shapes in the manner of engravings that prevent the palm of the hand from slipping and is also characterized by being of considerable roughness which confers the functionalities of giving firmness and stability even under wet conditions, favoring the handling and the grip of the rifle, giving the weapon a tactical character.

Figure 6:
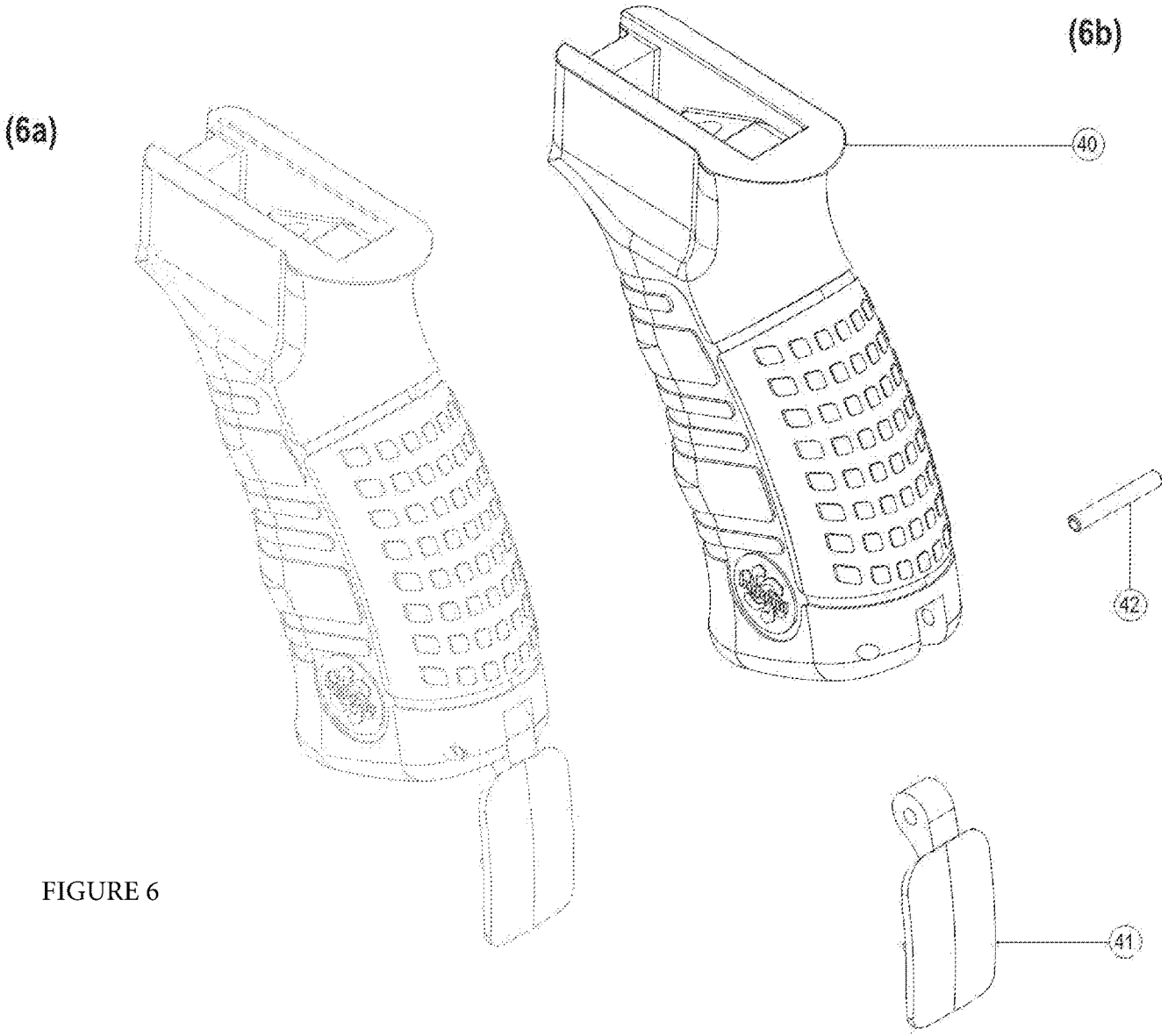
FIG. 6*a* shows an isometric of one modality of the assembled tactical grip assembly (D).
FIG. 6*b* shows an isometric exploded view of one modality of the tactical grip assembly (D).

The tactical grip assembly (D) as shown in FIG. 6*a* comprises a cavity in its upper part that allows its insertion in assault rifles, it also includes a hole through which the screw of the rifle receiver is passed through for its adaptation to the assault rifle. Unlike other rifle grips, the tactical grip assembly (D) includes a compartment inside for the placement of rifle cleaning implements, the coupling of sensors for rifle use statistics, and ammunition traceability sensors and others.

The compartment included in the internal cavity of the tactical handle assembly (D) and the provision of a handle cover (41) that pivots on a handle pin (42) and allows closing the compartment (normally open in conventional assault rifles) of the grip, giving it the functionalities of sensor adaptation, a secret compartment, the inclusion of a rifle cleaning kit, an aesthetic character and free of dirt from the environment that in conventional rifles are housed in said place, which can interfere with the devices electronic present.

Figure 7:
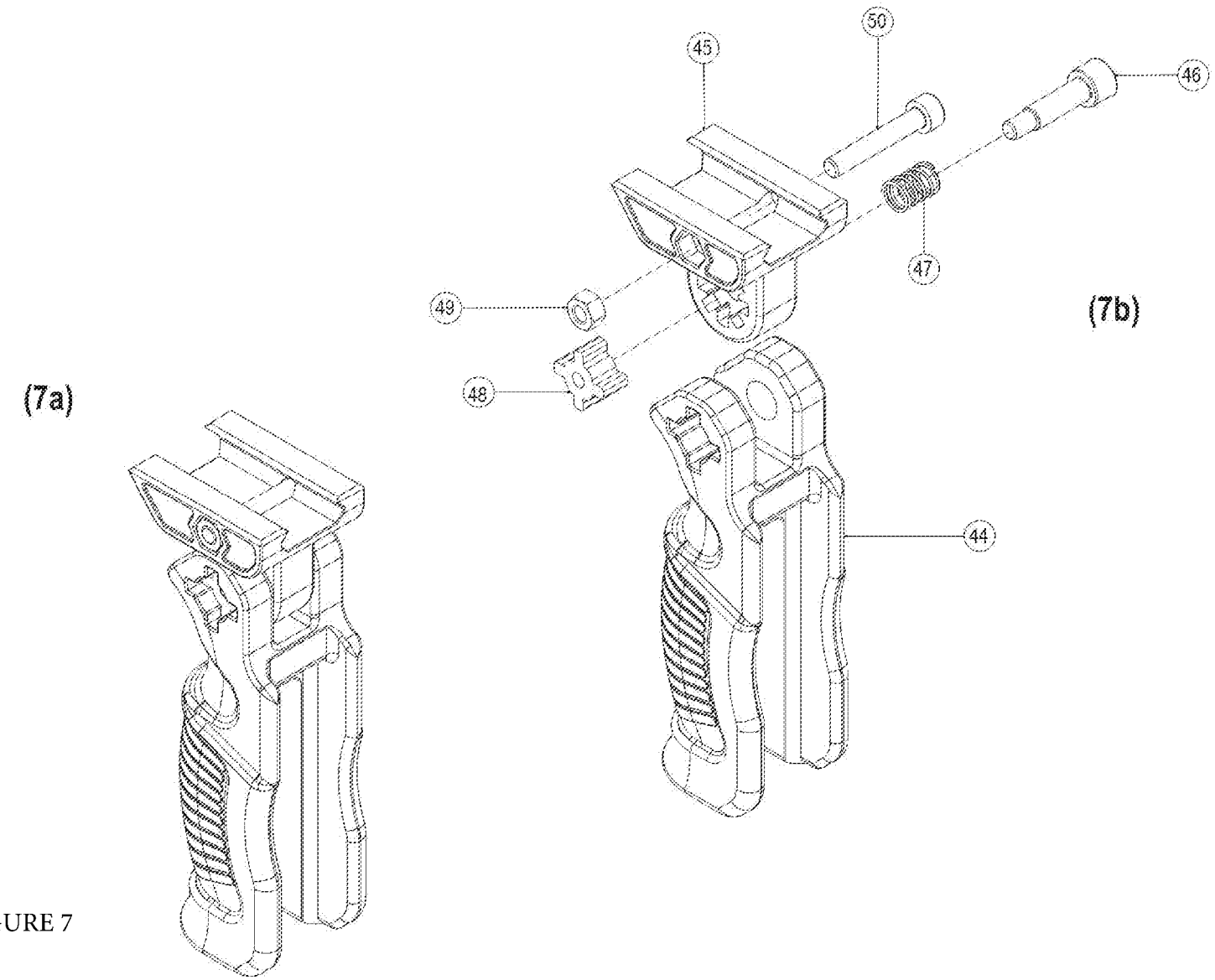
FIG. 7*a* shows an isometric of one modality of the assembled second handle assembly (E).
FIG. 7*b* shows an isometric exploded view of one modality of the second handle assembly (E).
Figure 8:
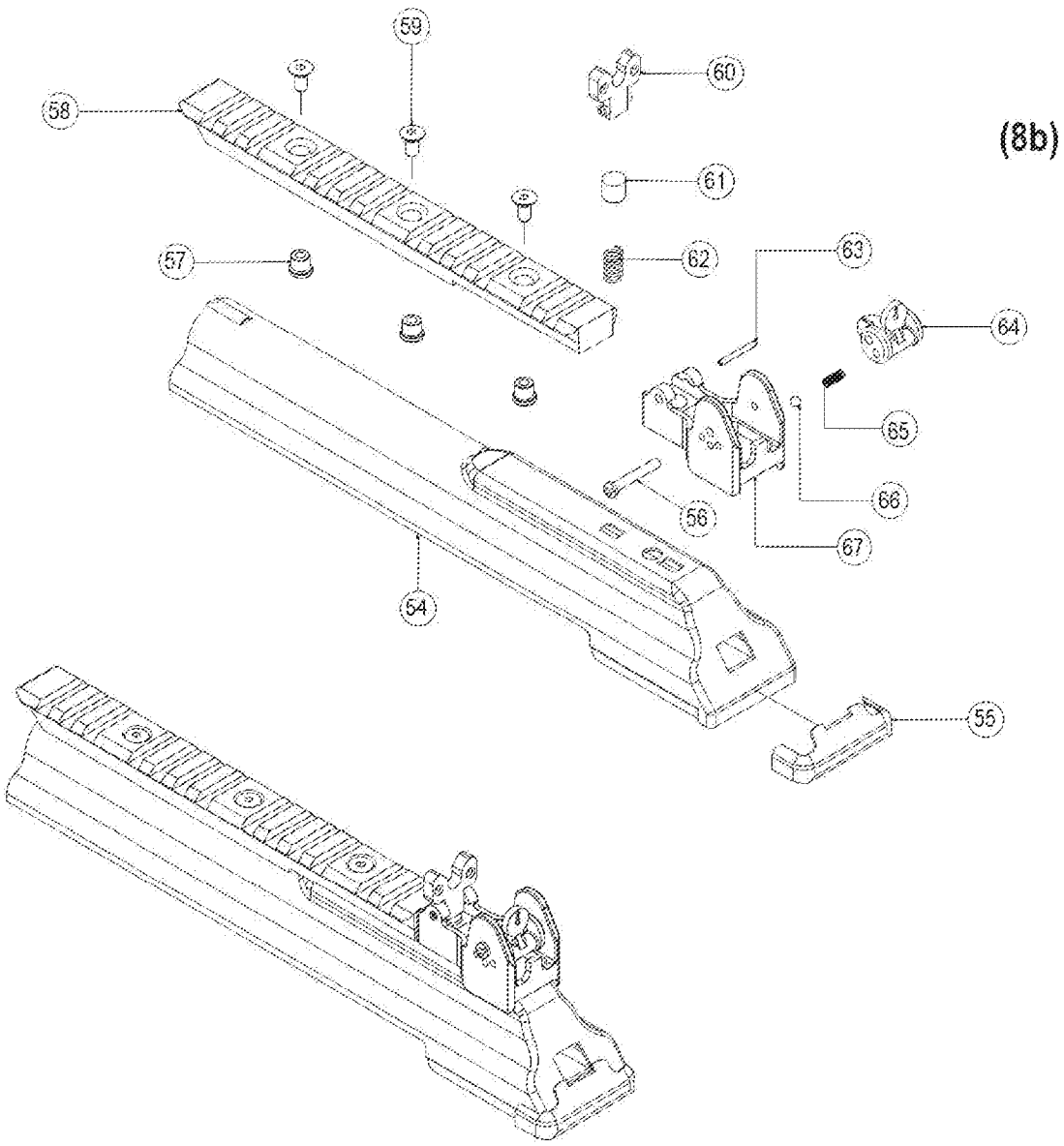
FIG. 8*a* shows an isometric of one modality of the assembled cover assembly (F).
FIG. 8*b* shows an isometric exploded view of one modality of the cover assembly (F).

The present invention also comprises a second handle assembly (E), which is characterized by providing additional support to the weapon, to balance the recoil forces of the same and provide a more stable handle giving an additional firmness to the user, than when taking consecutive shots will have a positive impact on the accuracy of the shots. The second grip assembly is characterized by comprising an adaptable geometry and fully compatible with the Picatinny rails that comprise the forearm assembly (A). An isometric view of the second handle assembly (E) is shown in FIG. 7*a*.

The second handle assembly (E) comprises a tactical handle (44) that is characterized by comprising multiple grooves in the manner of engraving that allow a comfortable grip and with an ergonomic shape that perfectly fit the user's hand and comprises a mechanism for graduation in four selected positions between 0° 45° 90° and 135° with respect to the axis of the barrel, which give a functional advantage to the operation of the rifle in tactical operations.

The mechanism for graduation in four positions is comprised of the assembly formed by the tactical grip button (46), the button spring (47) and the tactical grip retainer (48) that joins the tactical grip base (45) with the tactical grip (44) so that pressing the tactical grip button (46) allows the rotation of the tactical grip (44). The tactical grip button (46) is comprised of a stepped shaft with one end threaded and the other with a cavity that allows the insertion of tools for its adjustment, selected from hexagonal keys, torx keys, among others. The threaded end of the tactical grip button (46) is coupled to a threaded cavity in the tactical grip retainer (48) which is characterized by being a threadable insert as a nut with polymer that covers it in such a way that the geometry shown is generated. in FIG. 7*b*, which shows an exploded view of the second handle assembly (E).

In addition, the mechanism for graduation in four positions in its tactical grip retainer (48) is characterized by having a geometry that is characterized by firmly fitting into a cavity with the same shape and slightly larger dimensions arranged in the grip. tactic (44). In addition, the tactical grip retainer (48) comprises a length that allows the tactical grip retainer (48) to free the cavity of the geometry comprised by the tactical grip base (45) by actuating the tactical grip button (46) and return to its original locking position by aligning the geometries present in the tactical grip base (45) and the tactical grip retainer (48) by means of the use of a stockbutton spring (47) arranged between the geometry of a section change of the tactical grip button (46) and the tactical grip (44). The tactical grip base (45) comprises a selected geometry of four overlapping rectangles every 45° that allow graduation in the four described positions that together with the upper geometry of the tactical grip (44) generate geometric interference in such a way that the whole second handle (E) remains stable in the described positions, arrangements and geometries shown in the exploded view of FIG. 7*b*.

The set of second handle (E) is attached to the rails Picatinny arranged in the present invention because it is characterized by comprising a geometry with a cavity compatible therewith which attaches to the set of second handle (E) in the transverse direction of the Picatinny rail and comprises a through hole characterized by the fact that half its circumference is uncovered in the part in contact with the rail, so that when a screw (50) is inserted through it, it generates geometric interference with the cavities arranged in the Picatinny rail in such a way as to prevent movement of the second grip assembly (E) in the longitudinal direction of the axis of the Picatinny rail and the second grip assembly (E) remains firmly on the rifle.

The present invention is characterized by comprising a cover assembly (F), which is characterized by comprising a receiver cover (54), a rear reinforcement (55), a rear sight pivot screw (56), a plurality of bolts of internal thread (57) a rail picatinny cover (58), a plurality of screws picatinny cover (59), a rear night sight (60), a plunger with night sight (61), a spring of the plunger (62), a bolt rear night sight (63), a rear sight (64), a ball spring (65), a ball (66) and a rear sight base (67). In addition, the present set is characterized by its adaptability to different types of rifle with minor modifications, through the incorporation of a plurality of internal thread bolts (57) which in one mode of the present invention are welded to the receiver cover (54) in related positions to the cover picatinny rail (58) so that they fit together, and the rail is secured using a plurality of cover picatinny screws (59). This set provides the adaptation to any type of cover without damaging its components or making major modifications and confers the tactical ability to couple different tactical devices such as sights, lasers, vision multipliers, among others.

The figures presented in this description correspond to merely illustrative purposes of the invention. It is implied that the described figures do not limit the scope of the disclosed invention. A person skilled in the art is capable of conceiving subsequent modifications to the principles determined in this document.

Although some modalities of the invention are described in the present description, it will be appreciated that numerous modifications and other modalities may be devised by those skilled in the art subsequent to the disclosure of the present invention. For example, the features described here can be applied in other modalities. Therefore, it will be understood that the appended claims are intended to cover all modifications and modalities that are within the spirit and scope of the present disclosure.

What is claimed is:

1. An assault rifle conversion kit comprising:

a stock assembly (C), a first handle assembly (D), a second handle assembly (E), a cover assembly (F), a reload handle assembly (B);

a handguard assembly (A), wherein the reload handle assembly (B) comprises a reload handle base complement (14), a reload handle base (15) joined by refill handle screws (17), and a reload handle (16) having a threaded projection, wherein the threaded projection is secured into a threaded hole on the refill handle base (15);

wherein the reload handle base complement (14) is connected in a horizontal orientation with regards to the assault rifle; thus, the reload handle is horizontally aligned with regards to the assault rifle;

wherein the second handle assembly (E) comprises a tactical handle (44) having a graduation mechanism to graduate the second handle assembly a selected position between 0°, 45°, 90° and 135° with respect to an axis of a barrel;

wherein the stock assembly (C) comprises an adjustable cheek support system (C3) having a continuous graduation and includes a stock plate (34) having a curved shape.

2. The assault rifle conversion kit as in claim 1, wherein the handguard assembly (A) comprises a heat sink assembly (A1) and an adaptable tactical handguard assembly (A2).

3. The assault rifle conversion kit as in claim 2, wherein the heat sink assembly (A1) comprises a right handguard support (1) and a left handguard support (2), which are joined by a fastening device and do not require modification of the barrel, and an insulator (5) that allows heat dissipation.

4. The assault rifle conversion kit as in claim 3, further comprising spacers (6) that prevent heat transfer and the fastening device is selected from a top screw support forend (3), a lower screw support handguard (4), and a handguard screw (13).

5. The assault rifle conversion kit as in claim 4, wherein the right handguard support (1), the left handguard support (2), the fastening device, and the spacers (6) are made of materials with conductivities reduced thermal sensors selected from stainless steel and the insulator (5) are made of a material with a high thermal conductivity selected from aluminum.

6. The assault rifle conversion kit as in claim 4, wherein the adaptable tactical handguard assembly (A2) comprises a handguard (7), attached to the isolator (5) joint with the spacers (6); and a handguard cover (12);

wherein the handguard (7) and the handguard cover (12) are joined with the handguard screw (13) and a fixing screw nut (11) to the right handguard support (1) and the left handguard support (2) is joined to the barrel of the rifle without modifying the barrel.

7. The assault rifle conversion kit as in claim 6, wherein the handguard (7) comprises picatinny rails selected from mock picatinny rails (9) selected as removable and rails picatinny fixed.

8. The assault rifle conversion kit as in claim 1, wherein the stock assembly (C) further comprises a folding mechanism with a lock (C1) that allows folding the stock and a retractable telescopic button mechanism (C2) that allows graduation to users of different heights.

9. An assault rifle conversion kit comprising:

a stock assembly (C), a first handle assembly (D), a second handle assembly (E), a cover assembly (F), a reload handle assembly (B);

a handguard assembly (A), wherein the reload handle assembly (B) comprises a reload handle base complement (14), a reload handle base (15) joined by refill handle screws (17), and a reload handle (16) having a threaded projection, wherein the threaded projection is secured into a threaded hole on the refill handle base (15);

wherein the reload handle base complement (14) is connected in a horizontal orientation with regards to the assault rifle; thus, the reload handle is horizontally aligned with regards to the assault rifle;

wherein the second handle assembly (E) comprises a tactical handle (44) having a graduation mechanism to graduate the second handle assembly a selected position between 0°, 45°, 90° and 135° with respect to an axis of a barrel;

wherein the stock assembly (C) comprises an adjustable cheek support system (C3) having a continuous graduation and includes a stock plate (34) having a curved shape;

wherein the stock assembly (C) further comprises a folding mechanism with a lock (C1) that allows folding the stock and a retractable telescopic button mechanism (C2) that allows graduation to users of different heights;

wherein the folding mechanism with lock (C1) comprises:

a base adapter stock (19) that is attached to a rear of the assault rifle and allows the stock to be folded up either to the right or to the left;

a stock bolt (18) that secures the stock base adapter (19) to the weapon;

a cylinder head base block (20) attached to the cylinder head base adapter (19) by a screw (21) that rotates at angles of up to 180°;

a joint block (25), which houses a cylinder head base shaft (22) that allows the locking mechanism of the cylinder head to be released and deployed, the joint block (25) includes a slot where a cylinder head guide (28) and a guide core (52) are housed, the cylinder head guide (28) and the guide core (52) are permanently attached to each other and made of different materials;

wherein the cylinder head base shaft (22) is cylindrical with section changes;

wherein the section change secures the shaft (22) by the cylinder head fixing ring (51), which prevents the shaft from being expelled by a cylinder head base spring (23) and allows the shaft (22) to return to an original position; and wherein the cylinder head base shaft (22) allows the vertical movement of the union block (25) provided by the cylinder head base spring (23).

10. The assault rifle conversion kit as in claim 9, wherein said folding mechanism with lock (C1) comprises a butt base button (26) having a prominent projection and a no prominent projection, the prominent projection includes a knurling to operate without slipping and the no prominent projection generates geometric interference between the cylinder head base block (20) and the butt base button (26) due to the pivoting of the union block (25) and is kept in said position by the spring cylinder head button (31); an elastic coil pin (24) that prevents the butt base button (26) from being ejected and fixed to the union block (25); wherein the pressure of the butt base button (26) compresses the button spring button head (31), releases the union block (25) of said interference and permits and brings down the cylinder head.

11. The assault rifle conversion kit as in claim 10, wherein the union block (25) comprises a rifle holder system comprising a weapon holder screw (70), to which a weapon holder ring (69) is attached by a weapon holder ring pin (68) and a fastener.

12. The assault rifle conversion kit as in claim 8, wherein the retractable telescopic button mechanism (C2) is attached to the folding mechanism with lock (C1) by a slot and comprises a stock (30) having a cavity for a cylinder head guide body (28) that allows a linear movement of a telescopic system; a cylinder head retainer (32) including a base comprising two projections, one of them with the cylinder head button spring (31) that returns the cylinder head button (35) to the locked position; and the butt plate (34) that is fixed to the stock (30) by multiple elastic pins (37).

13. The assault rifle conversion kit as in claim 8, wherein the adjustable cheek support system (C3) further includes a shaft (33) to join the cheek rest (29) to the cylinder head (30) and a dowel pin (39) that prevents an assembly formed by an insert knob-cheek rest (53) and a nut cheek rest knob (36) accidentally comes out of its junction with the shaft (33).

14. The assault rifle conversion kit as in claim 1, wherein the first handle assembly (D) further comprises a grip (40) with multiple grooves to prevent user's fingers from sliding;

a cavity coupled to the rifle;

a compartment for the storage of objects; and a handle cover (41) that pivots on a handle pin (42) and allows the compartment to be closed.

15. The assault rifle conversion kit as in claim 1, wherein the graduation mechanism comprises a tactical grip button (46), a button spring (47), and a tactical grip retainer (48) that joins the tactical grip base (45) with the tactical grip (44) so that when pressing the tactical grip button (46) allows the rotation of the tactical grip (44) by releasing a geometric interference with multiple contact points and by removing the pressure, the button spring (47) allows the button (46) to return to its original position.

16. The assault rifle conversion kit as in claim 1, wherein the cover assembly (F) comprises a receiver cover (54), a rear reinforcement (55), a rear sight pivot screw (56), multiple internal thread bolts (57), a covered picatinny rail (58), multiple cover picatinny screws (59), a rear night sight (60), a night sight plunger (61), a plunger spring (62), a rear night sight bolt (63), a rear sight (64), a ball spring (65), a ball (66) and a rear sight base (67).

* * * * *